US006355140B1

(12) United States Patent
Murakami et al.

(10) Patent No.: US 6,355,140 B1
(45) Date of Patent: Mar. 12, 2002

(54) METHOD OF MANUFACTURING ANTI-FALSIFICATION PAPER

(75) Inventors: Toru Murakami, Mishima; Masaaki Suyama, Numazu, both of (JP)

(73) Assignee: Tokushu Paper Mfg. Co., Ltd., Shizuoka (JP)

( * ) Notice: Subject to any disclaimer, the term of this patent is extended or adjusted under 35 U.S.C. 154(b) by 0 days.

(21) Appl. No.: 09/743,095

(22) PCT Filed: Jun. 15, 1998

(86) PCT No.: PCT/JP95/03295

§ 371 Date: Jan. 5, 2001

§ 102(e) Date: Jan. 5, 2001

(87) PCT Pub. No.: WO00/73583

PCT Pub. Date: Dec. 7, 2000

(30) Foreign Application Priority Data

May 28, 1999 (JP) ..... 11-150085

(51) Int. Cl.[7] ..... D21H 21/42

(52) U.S. Cl. ..... 162/140; 162/105; 162/103; 283/72; 283/83

(58) Field of Search ..... 162/103–106, 162/140, 134, 133, 132, 108; 283/72, 83, 91, 57, 901

(56) References Cited

U.S. PATENT DOCUMENTS 4,437,935 A * 3/1984 Crane, Jr. ..... 162/103
4,462,866 A 7/1984 Tooth et al.
4,552,617 A * 11/1985 Crane ..... 162/103
4,652,015 A * 3/1987 Crane ..... 283/91
5,405,500 A * 4/1995 Knight ..... 162/103
5,573,639 A * 11/1996 Schmitz et al. ..... 162/140
5,961,432 A * 10/1999 Murakami et al. ..... 493/187

FOREIGN PATENT DOCUMENTS

| | | |
|---|---|---|
| EP | 0 195 887 | 10/1986 |
| JP | 5-85680 | 12/1993 |
| JP | 6-272200 | 9/1994 |

* cited by examiner

*Primary Examiner*—Jose Fortuna
(74) *Attorney, Agent, or Firm*—Wenderoth, Lind & Ponack, L.L.P.

(57) ABSTRACT

A method of manufacturing a thread-inserted window paper produces paper in which a thread is exposed to windows which are intermittently formed, and have clear contours, and in which thread is exposed surely at the window portions to make the thread clearly recognizable visually. The method is capable of being carried out with a relatively simple apparatus. Wet paper (1) in which a thread (T) is embedded in the paper layer is guided while being in intimate contact with a center roll (3) having protrusions (2) arranged on the surface thereof intermittently at a predetermined distance, the surface of the wet paper on the protrusions is frictionally rubbed by a friction roll (4) thereby moving fibers at the surface of the wet paper on the protrusions to form exposed portions of the thread intermittently on the surface of the wet paper and the wet paper is then dried by a customary method.

22 Claims, 4 Drawing Sheets

METHOD OF MANUFACTURING ANTI-FALSIFICATION PAPER

TECHNICAL FIELD

This invention concerns a method of manufacturing anti-falsification paper. More specifically, it relates to a method of manufacturing anti-falsification paper which is so-called "thread-inserted, window paper" in which a thread is intermittently exposed to the surface of paper.

BACKGROUND OF THE INVENTION

Various anti-falsification countermeasures have been applied, for example, to bank notes and gift cards so that they can not be illegally modified or forged. One of the concepts for the anti-falsification countermeasures is to manufacture paper by using a manufacturing technique at such a high level to make manufacture not easy. As an example, there is anti-falsification paper referred to as "thread-inserted, window paper", which have been used generally for bank notes in many countries. FIG. 7 shows an example. FIG. 7 is an example of anti-falsification paper in which windows W are arranged each at a predetermined distance in right and left two rows in the machining direction of the paper upon manufacture thereof and a thread T is exposed intermittently in the windows.

Various manufacturing methods have been proposed for the thread-inserted, window paper. For example, Japanese Patent Publication No. 5-085680/1993 proposes a method of manufacturing thread-inserted, window paper by immersing a belt mechanism, which has a groove with a thread being passed through the top end of a protrusion of a guide of a convex/concave shape, in a liquid paper stock suspension on wire cloth.

Further, Japanese Patent Laid-Open No. 6-272200/1994 proposes a method of installing a pressurized air nozzle in a rotary drum disposed on wire cloth in a Fourdrinier paper machine and intermittently blowing off the pulp slurry deposited on the thread previously embedded into wet paper with pressurized air thereby exposing the thread.

Further, U.S. Pat. No. 4,462,866 proposes a method of using a wire mesh having raised portions as a face wire of a cylinder paper machine and incorporating a thread while bringing it into contact with the raised portions on the surface of the wire mesh thereby inserting and exposing the thread in windows.

The method of manufacturing the thread-inserted, window paper proposed by Japanese Patent Publication No. 5-085680/1993 involves problems in that the apparatus is complicated, contours of the windows become obscure if the drained condition of the paper stock on the wire cloth fluctuates even slightly, the thread can not clearly be recognized visually or it is extremely difficult to keep the belt horizontal relative to the paper machine since the belt expands outwardly by a centrifugal force during operation, failing to stably insert the thread.

Further, the thread-inserted, window paper proposed in Japanese Patent Laid-Open No. 6-272200/1994 involves a problem that since pressurized air blows off the paper slurry in an unnecessarily excessive amount, the formation at that portion is deteriorated and, on the other hand, when the pneumatic pressure of pressurized air is lowered for preventing this, portions in which the thread is not exposed to the surface of water mark portions are increased, which also making it impossible to clearly recognize the thread visually.

Further, the thread-inserted, window paper proposed in U.S. Pat. No. 4,462,866 involves a problem that the contours of the windows becomes obscure since the window is formed by fabricating the wire mesh into a shape having raised portions and. thus the thread can not clearly be observed visually. Further, when different kinds of thread-inserted, window paper are intended to be manufactured, since the cylinder face wire has to be replaced after once stopping the paper machine, it results in a problem that the cost is increased in the manufacture of small lot paper.

DISCLOSURE OF THE INVENTION

This invention has an object to solve the problems in the prior art described above. Specifically, it intends to provide a novel method of manufacturing thread-inserted, window paper, capable of shortening the stopping period of a paper machine even for the manufacture of different kinds of paper by a relatively simple apparatus, the resulting paper having windows of clear contours, thread being exposed surely at the window portions and the exposed thread being clearly recognizable visually.

A gist of this invention resides in a method of manufacturing anti-falsification paper, which comprises guiding wet paper in which a thread is embedded in a paper layer while being in intimate contact with a center roll having protrusions arranged on the surface thereof intermittently at a predetermined distance, frictionally rubbing the surface of the wet paper on the protrusions by a friction roll thereby moving fibers at the surface of the wet paper on the protrusions to form exposed portions of the thread intermittently on the surface of the wet paper and then drying the same.

BEST MODE FOR CARRYING OUT THE INVENTION

Figure 1:
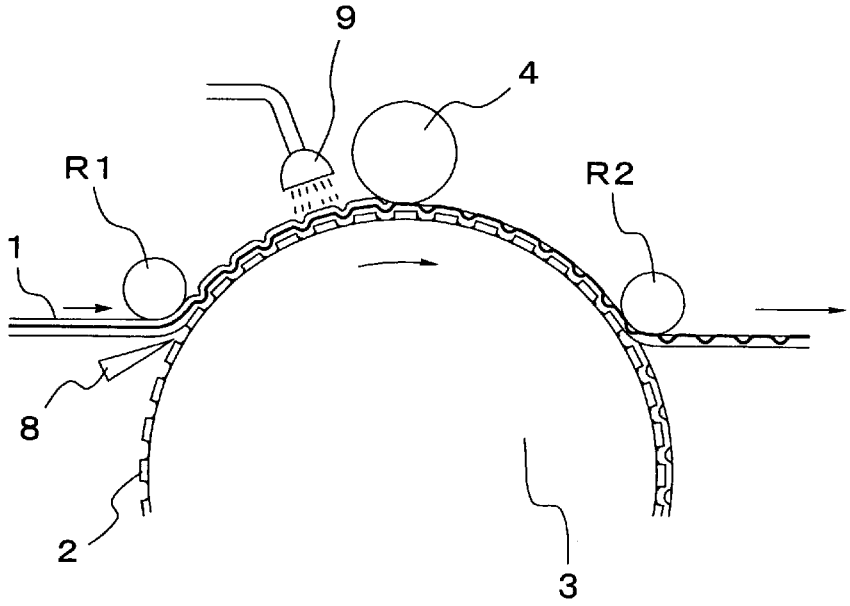
FIG. 1 is a conceptional view illustrating an example of an apparatus used for a method of manufacturing anti-falsification paper according to this invention.
Figure 2:
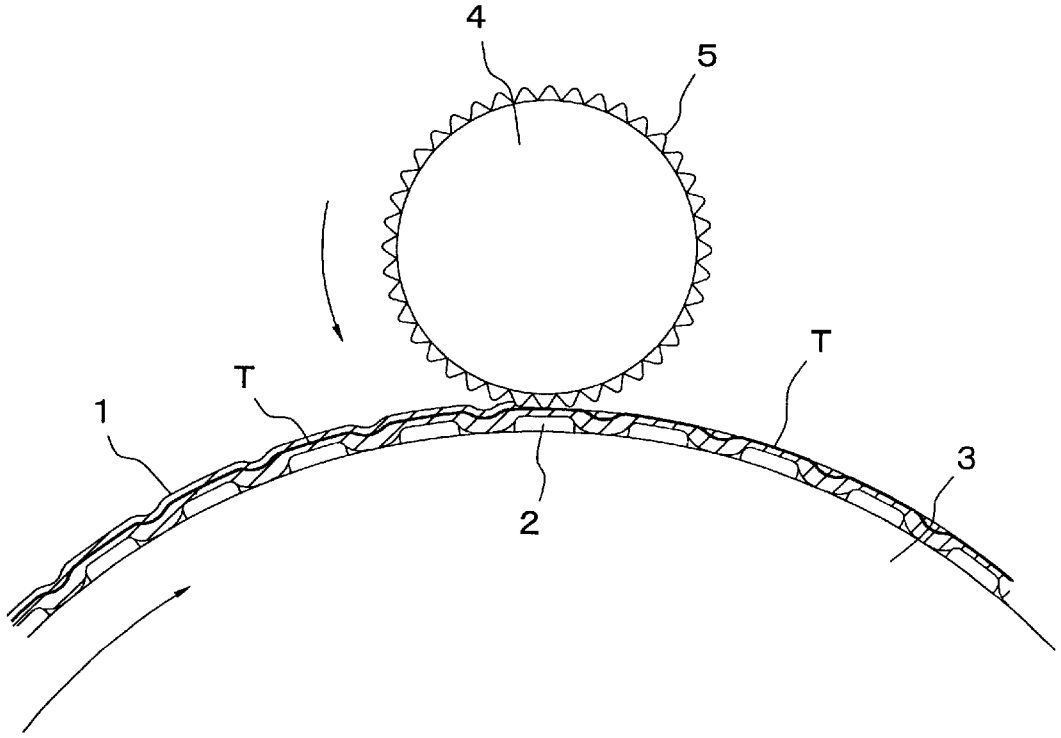
FIG. 2 is an enlarged view for a portion of a center roll and a friction roll in FIG. 1.

This invention is to be explained in details with reference to the drawings. FIG. 1 is a conceptional view illustrating an example of an apparatus used for a method of manufacturing anti-falsification paper according to this invention, and FIG. 2 is an enlarged view for a portion thereof. Wet paper or wet web 1 in which a thread is embedded in a paper layer is guided by a paper roll R1 to a center roll 3 and brought into an intimate contact with the surface thereof. The feeding speed of the wet paper is made identical or substantially identical with a rotational speed of the center roll. On the surface of the center roll 3, there are disposed a plurality of protrusions 2 arranged intermittently at a predetermined distance along the circumferential direction. A friction roll 4 is disposed adjacent to the center roll 3. FIG. 1 illustrates an example of disposing a single friction roll but the friction roll may be disposed in plurality. The wet paper 1 is guided to a paper roll R2 while being in contact with the friction roll 4.

The paper rolls R may be made of any material such as metal, plastic, rubber or the like and the use of an elastic rubber roll is preferred in this invention in order that air does not intrude between the center roll 3 and the wet paper 1 and that the wet paper is introduced between the protrusions. Further, when a suction nozzle 8 is disposed at the position where the wet paper 1 is guided by the paper roll R1 to a position just before intimate contact with the center roll 3, and air between the center roll 3 and the paper roll R1 is sucked by the suction nozzle so as not to involve air between the wet paper 1 and the center roll 3, uneven movement of fibers caused by involved air can be prevented.

The suction nozzle 8 is constructed as a nozzle with a top end being formed an acute angle capable of sucking air toward the inside. It is effective to dispose the top end of the suction nozzle in parallel with the paper roll R1 at a position where the center roll 3 and the paper roll R1 are closest to each other and at a position closest to the wet paper 1.

The friction roll 4 is adapted such that it can rotate independently of the center roll. The rotational direction is adapted such that it can rotate in the direction identical with or opposite to the direction of the center roll 3, and the rotational speed is made variable from one to several to several tens of times of the rotational speed of the center roll.

As can be seen from FIG. 2, a thread T embedded in the paper layer of the wet paper 1 placed on the protrusions 2 formed on the surface of the center roll 3 is exposed when the surface of the wet paper is frictionally rubbed by the friction roll 4 to move the fibers. The gap between the center roll 3 and the friction roll 4 is made adjustable subtly such that the paper layer is not fractured upon friction of the wet paper by the friction roll 4 and operation is conducted in a state where the friction roll 4 and the wet paper 1 are in slight contact with each other.

The center roll 3 is made of material, for example, a metal such as iron, stainless steel, copper or bronze, or plastic and usually has a diameter from several tens centimeters to several meters. Further, the width is usually from several tens centimeters to several meters.

Figure 3:
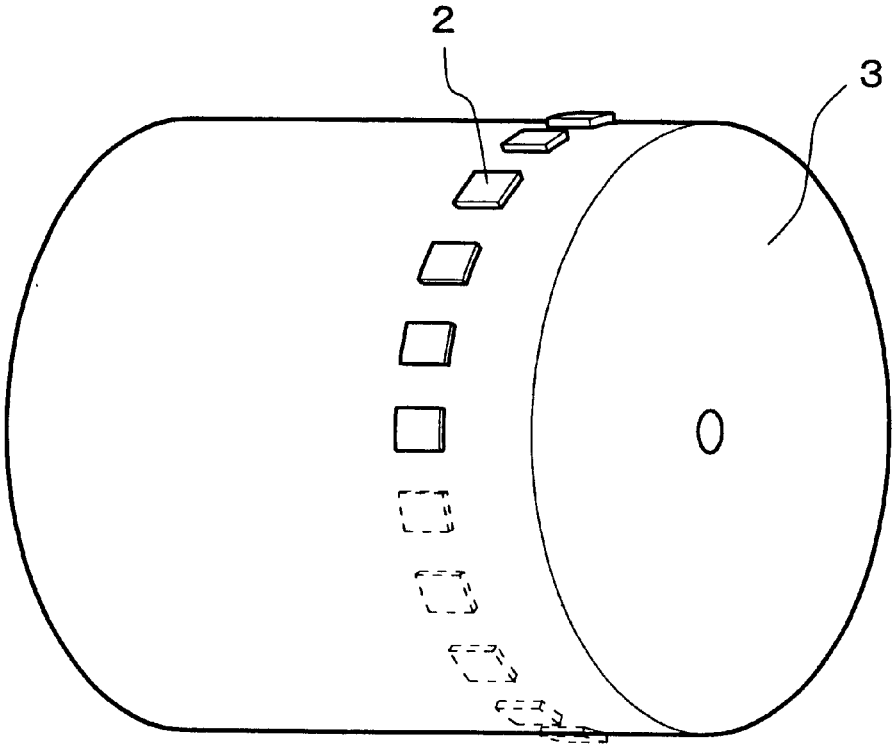
FIG. 3 is a perspective view illustrating a row of protrusions formed on the surface of the center roll.
Figure 7:
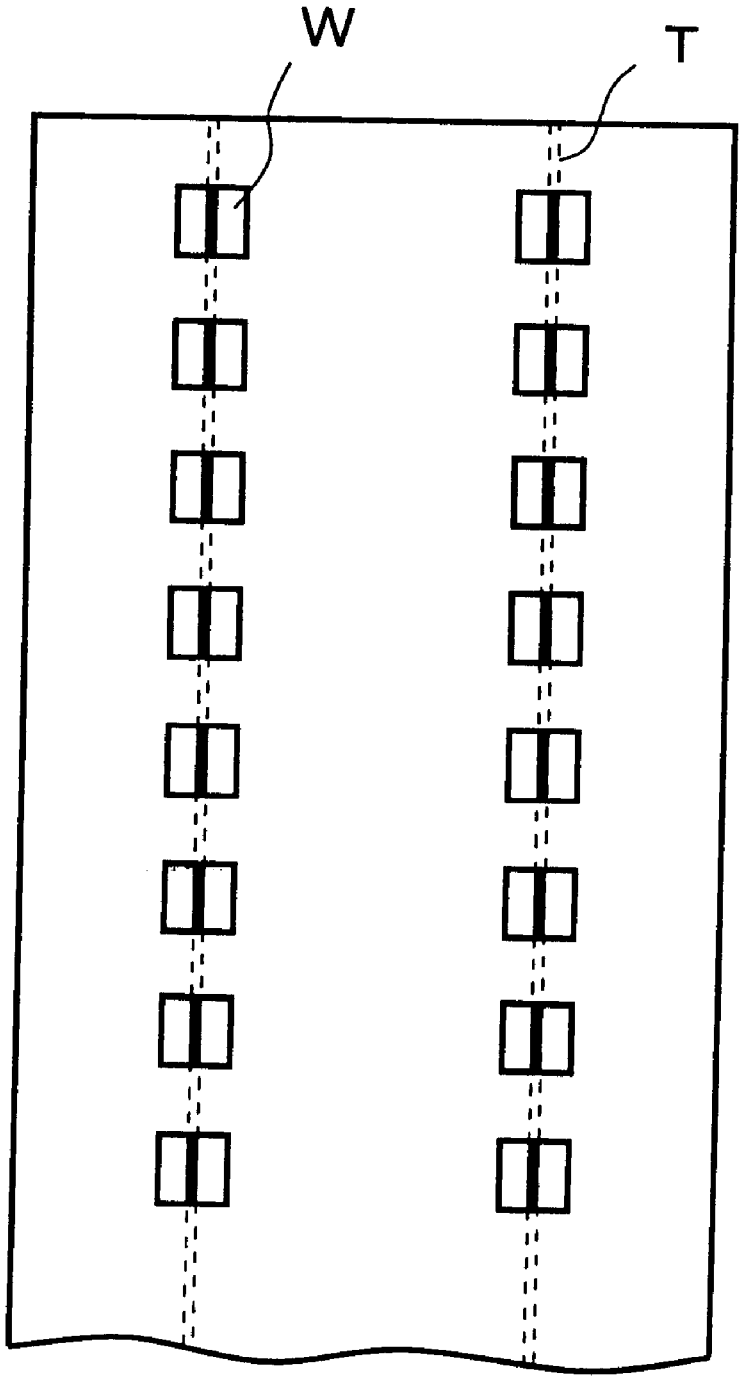
FIG. 7 is a plan view illustrating an example of anti-falsification paper (thread-inserted, window paper) manufactured by the method according to this invention.

As shown in FIG. 3, protrusions 2 are arranged on the surface of the center roll 3 being disposed intermittently at a predetermined distance and the portions of the wet paper in contact with the row of the protrusions form the row of windows W of the anti-falsification paper as shown in FIG. 7. The row of protrusions can be formed by grinding the surface of the center roll 3, or can be formed simply by preparing a plastic plate in which a row of protrusions is formed by a hot pressing molding or like other method, and securing the plastic plate to the surface of the center roll 3, for example, by using small screws or securing by using an adhesive or a pressure sensitive adhesive double coated tape. In FIG. 3, only one row of protrusions is illustrated but a plurality of protrusion rows may optionally be disposed in the lateral direction of the center roll.

Figure 5:
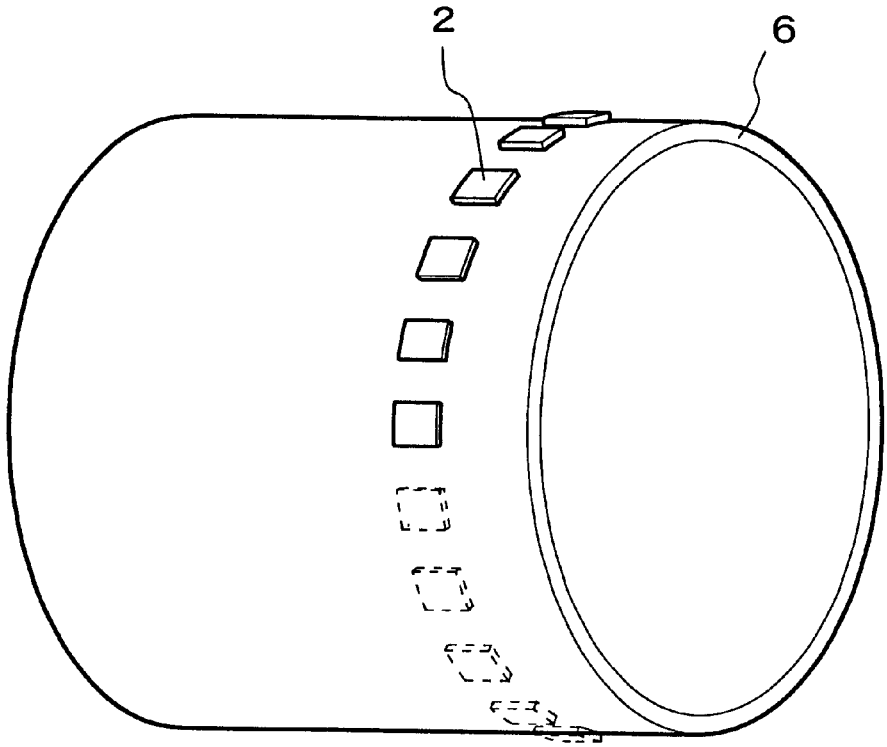
FIG. 5 is a perspective view illustrating a cylindrical sleeve having protrusions arranged on the surface thereof.

The center roll 4 having a row of protrusions disposed on the surface thereof may be of a structure in which a row of protrusions is disposed on the surface of a cylindrical metal sleeve 6 with a thickness from several millimeters to several tens millimeters, as shown in FIG. 5, and the sleeve 6 is detachably fitted to the outer circumference of a rotational body (not illustrated). In such a structure, since the sleeve can be quickly attached or detached to or from the rotational body while operating a wet part of the paper machine, anti-falsification paper of small lot can be produced efficiently.

The size for the individual protrusions 2 is determined depending on the size of the required window and it is generally made such that the size in the circumferential direction of the center roll is from 5 to 30 mm, the size in the lateral direction of the center roll is from 3 to 30 mm and the distance between each of the protrusions is from 5 to 30 mm. Further, the height of the protrusion is generally from 0.1 to 0.5 mm. Any arbitrary shape such as square, rectangular, as well as circular or oval shape may be adopted as the shape of the protrusion 2. It has also been known a technique of applying water marks to paper by using such protrusions but it is necessary to indent convex/concave portions corresponding to the water mark pattern on the surface of protrusions for applying the water marks. On the contrary, since the protrusion of this invention has a function of uniformly reducing the thickness of the paper layer to form windows W, no substantial convex/concave portion is disposed on the surface of the protrusion.

Figure 4:
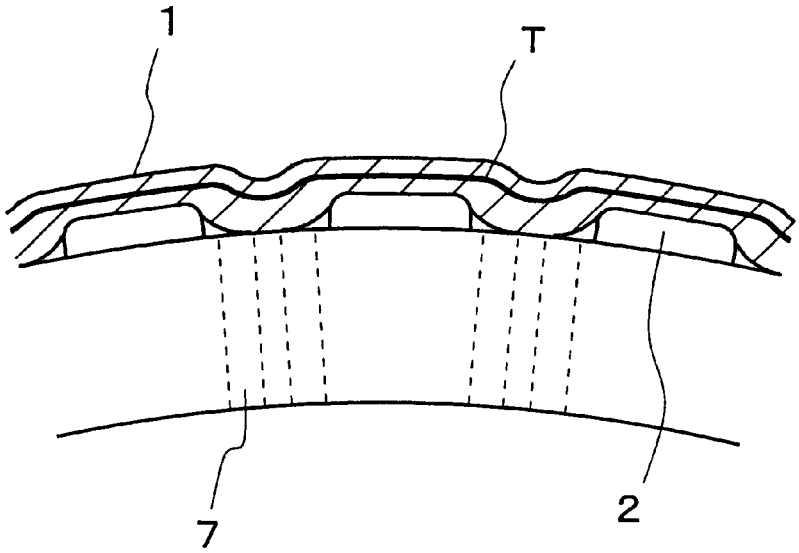
FIG. 4 is an explanatory view for sucking holes formed on the surface of the center roll.

As shown in FIG. 4, a suction hole 7 for sucking the wet paper may also be disposed on the surface of the center roll 3 between each of the protrusions with an aim of improving the intimate contact between the wet paper and the center roll. When the suction hole 7 has a mechanism of sucking air toward the inside of the center roll, the wet paper is sucked and secured at that portion to prevent a subtle displacement of the wet paper when the wet paper is frictionally rubbed by the friction roll 4.

The friction roll 4 is prepared from the material, for example, a metal such as iron, stainless steel, copper or bronze, or plastics and usually has a diameter of from several centimeters to several tens centimeters. Further, the width is from several tens centimeters to several meters.

The friction roll 4 used in this invention can improve the moving efficiency of fibers of the wet paper on the protrusions 2 by forming fine convex/concave portions 5 on the surface thereof as shown in FIG. 2.

As can be seen from the foregoings, when the wet paper 1 having a thread T embedded in the paper layer is guided while being in intimate contact with the center roll 3, the surface of the wet paper 1 placed on the protrusions 2 of the center roll is frictionally rubbed by the friction roll 4. By moving the fibers on the surface of the wet paper by the friction, the exposed portions of the thread corresponding to the row of protrusions are formed intermittently along the machining direction of the paper. Then, the thread-inserted, window paper can be manufactured by drying the wet paper by an ordinary method.

The method of manufacturing wet paper in which the thread is embedded in a paper layer is to be explained below. At first, wood pulps, for example, chemical pulps such as hardwood bleached kraft pulp (LBKP), conifer bleached kraft pulp (NBKP), hardwood sulfite pulp (LBSP) and conifer bleached sulfite pulp (NBSP), mechanical pulps such as ground pulp (GP) or thermo-mechanical pipe (TMP), non-wood pulps such as cotton pulp, hemp, bagasse, kenaf, esparto, paper mulberry, paper bush and ganpi are used alone or in combination of two or more of them, to which dry paper strength agent, wet paper strength agent, sizing agent, fixing agent, retention aid, drainage aid, anti-foaming agent, dye, coloring pigment and the like are added appropriately, to prepare a paper stock having the freeness of from 250 to 550 ml C. S. F.

Various methods of manufacturing wet paper in which a thread is embedded in the paper layer have been proposed and, in this invention, a single layer forming method or multi-layer forming method may be adopted. As a single layer forming method, a method of delivering a thread together with a paper stock fed from a slice to a paper making wire cloth in a Fourdrinier paper machine and embedding the thread to the inside of the paper layer formed on the wire cloth may be adopted. As the multi-layer forming method, a method of inserting the thread between paper layers just before stacking each of the paper layers upon multi-layer combination, for example, by using a cylindrical paper machine may be adopted.

In the multi-layer combination, wet paper in which a thread is embedded between the paper layers is obtained and such wet paper is also included within "wet paper in which thread is embedded in the paper layer" in the present invention.

The water content of the wet paper in which the thread is embedded in the paper layer according to this invention is usually from 30 to 70% by weight, preferably, from 50 to 60% by weight and the basis weight (on dry weight) is usually from 60 to 150 g/m$^2$.

In this invention, when the surface of the wet paper in which the thread is embedded in the paper layer is frictionally rubbed by the friction roll, movement of the fibers can be promoted by providing the surface of the wet paper with water by using a water adding device 9 such as a spray as shown. in FIG. 1. In this case, it is not necessary to provide water over the entire surface of the wet paper but it may suffice that water is added selectively only to the thread-exposed portions.

The thread T used in this invention may be any kind of threads proposed so far for anti-falsification, such as goldsilver thread, hologram thread, magnetic thread, fluorescent thread and the like. For example, the goldsilver thread is made by vacuum depositing metal aluminum on a polyester film, coating a resin to the deposited surface for protection and slitting it into a thread by a micro-slitter. By coloring the resin in yellow, a thread of a gold color can be formed. The thread is preferably applied with a heat sensitive adhesive, and the thread and the paper are adhered by heat in the dry zone in the paper making machine. The thread, has a width usually of 0.3 to 3 mm and thickness of 12 $\mu$m to 50 $\mu$m.

Figure 6:
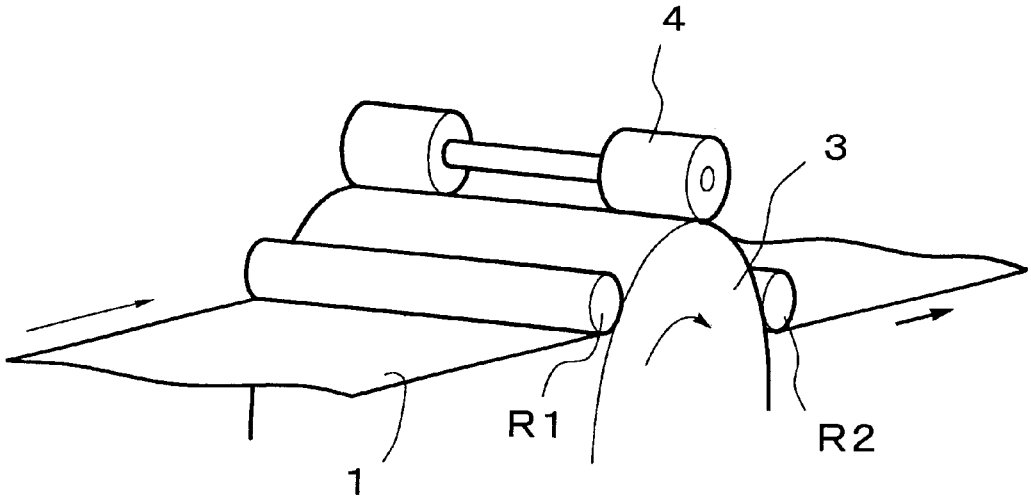
FIG. 6 is a perspective view illustrating an example of an apparatus using a friction roll having a partially reduced diameter.

As shown in FIG. 6, when a diameter of the friction roll used in this invention is decreased at a portion other than that in contact with the protrusion 2 by way of the wet paper 1 in which the thread is embedded in the paper layer, the wet paper at a portion other than that is intended to expose the thread to the surface of the paper is no more in contact with the friction roll, so that the surface of the paper is not roughened unnecessarily. Further, the design for the pressure mechanism for pressing the friction roll against the wet paper may be made to a lower pressure.

This invention is to be explained more concretely by way of examples to be shown below. In the example, anti-falsification paper was manufactured by using the apparatus shown in FIG. 1.

EXAMPLE

Manufacture of a Center Roll Having Intermittent Protrusions Disposed on the Surface Thereof A stainless steel roll of 1.5 m diameter and 1300 mm width was prepared. A plurality of protrusions each with a width of 5 mm in the lateral size, width of 10 mm in the circumferential size and a 0.25 mm height of the roll are arranged on, the surface thereof intermittently in the circumferentially direction of the roll with the distance between each of the protrusions being 10 mm. The rows of protrusions were disposed by six each at an equal interval in the lateral direction of the roll.

Preparation of Paper Stock and Making of Wet Paper in Which a Thread is Embedded Between Paper Layers 20 parts by weight of NBKP and 80 parts by weight of LBKP were beaten into 350 ml C.S.F. to which 10 parts by weight of white clay, 0.3 parts by weight of paper strength agent ("Polystron 191", trade name of products manufactured by Arakawa Kagaku Kogyo K. K.), 1.0 parts by weight of a sizing agent ("Sizepine E", trade name of product manufactured by Arakawa Kagaku Kogyo K. K.) and an appropriate amount of aluminum sulfate were added to prepare a paper stock. When two-layer combination paper of a basis weight of 100 g/m$^2$ (on dry weight) and 1300 mm of width was made by using the paper stock in a cylinder paper machine having two vats, threads each of 1.5 mm width were inserted by six rows at an equal distance between a paper layer formed in a first vat (first layer) and a paper layer formed in a second vat (second layer) just before they were stacked. In this case, the combination ratio (basis weight ratio between the first and the second paper layers) was set to 3:1. The position for inserting the thread was adjusted such that the thread was situated at the center for each of the rows of protrusions on the center roll. Then, they were dewatered by a press roll in accordance with a customary method to prepare wet paper of 50 wt % water content. The wet paper was guided to the apparatus shown in FIG. 1 assembled with a paper roll having a surface made of rubber and the center roll manufactured as described above.

Manufacture of Thread-inserted, Window Paper

A friction roll 4 of 100 mm diameter having fine concave/convex portions formed on the surface thereof was made closer to the center roll 3 so as to form a slight gap between the friction roll 4 and the wet paper, while rotating the friction roll 4 in the direction opposite to that of the center roll 3 and at a speed five times as high as the rotational speed of the center roll (6 rpm, that is, at 28.26 m/min). The wet paper on the protrusions formed on the surface of the center roll was slightly raised compared with other portions (refer to FIG. 2), so that when the friction roll was brought closer to the wet paper, cellulose fibers on the surface of the wet paper of the protrusions were compulsorily moved to the periphery. In this example, the paper layer formed in the first vat was frictionally rubbed. Thus, the threads embedded between the paper layers were intermittently exposed to the surface of the wet paper. Subsequently, the wet paper was dried by a multi-cylindrical drier in accordance with the customary method to obtain thread-inserted, window paper as shown in FIG. 6 in which windows with clear contours were formed intermittently and threads were exposed at the portions.

Industrial Applicability of the Invention

According to the method of manufacturing the anti-falsification paper of this invention, the following remarkable effects can be obtained.

(1) Compared with prior art methods of manufacturing thread-inserted, window paper by forming protrusions on the surface of wires or by appending molds, the apparatus can be manufactured relatively simply in this invention since it is possible to adopt a center roll formed by preparing a plastic plate having rows of protrusions formed integrally using a hot press method or the like and attaching the plastic plate to the outer circumference thereof.

(2) Since the apparatus comprising the center roll and the friction roll is simple in the structure and takes no large installation space, it can be used being incorporated in existent paper making machines. As a result, when the wet paper on the paper making machine is put to paper making process without passing through this apparatus, paper which is not thread-inserted, window paper can also be prepared and it can be adopted suitably to the manufacture of various kind and small lot production.

(3) Further, stopping time for the paper making machine can be shortened also upon paper exchange compared with prior art apparatus. Particularly, in a case of using a center roll having the structure of detachably fitting a cylindrical sleeve having protrusions arranged on the surface to the outer circumference of a rotational body, since the sleeve can be detached in a short period of time, paper can be exchanged while operating the wet parts of the paper making machine as they are.

(4) Since the thread-inserted, window paper obtained by the method according to this invention has windows with clear contours and threads are surely exposed to the portions, the threads can clearly be recognized visually.

What is claimed is:

1. A method of manufacturing anti-falsification paper, comprising:

guiding wet paper (1), having a thread (T) embedded in a paper layer thereof, over the surface of a center roll (3) which has protrusions (2) arranged on the surface thereof intermittently at a predetermined distance;

frictionally rubbing the surface of the wet paper on the protrusions by a friction roll (4) thereby moving fibers at the surface of the wet paper on the protrusions to form exposed portions of the thread intermittently on the surface of the wet paper; and drying said paper.

2. A method of manufacturing anti-falsification paper as defined in claim 1, wherein the center roll (3) has a structure including a cylindrical sleeve (6), having protrusions (2) arranged on the surface thereof, detachably fitted to the outer circumference of a rotational body.

3. A method of manufacturing anti-falsification paper as defined in claim 2, wherein fine undulations are formed on the surface of the friction roll.

4. A method of manufacturing anti-falsification paper as defined in claim 2, wherein a suction hole (7) for sucking the wet paper is disposed on the surface of the center roll between each of the protrusions.

5. A method of manufacturing anti-falsification paper as defined in claim 2, wherein the wet paper is guided by a paper roll (R1) to be brought into intimate contact with the center roll, and a suction nozzle (8), for sucking air, is disposed between the center roll and the paper roll at a position just before the intimate contact of the wet paper with the center roll so as to remove air between the wet paper and the center roll.

6. A method of manufacturing anti-falsification paper as defined in claim 2, wherein the friction roll has a diameter, at a portion other than that which frictionally rubs the surface of the wet paper on the protrusions, which is smaller than a diameter of the friction roll at a portion which frictionally rubs the surface of the wet paper on the protrusions.

7. A method of manufacturing anti-falsification paper as defined in claim 2, wherein a water adding device is used to provide the surface of the wet paper with water when the friction roll frictionally rubs the surface of the wet paper.

8. A method of manufacturing anti-falsification paper as defined in claim 1, wherein fine undulations are formed on the surface of the friction roll.

9. A method of manufacturing anti-falsification paper as defined in claim 8, wherein a water adding device is used to provide the surface of the wet paper with water when the friction roll frictionally rubs the surface of the wet paper.

10. A method of manufacturing anti-falsification paper as defined in claim 8, wherein a suction hole (7) for sucking the wet paper is disposed on the surface of the center roll between each of the protrusions.

11. A method of manufacturing anti-falsification paper as defined in claim 8, wherein the friction roll has a diameter, at a portion other than that which frictionally rubs the surface of the wet paper on the protrusions, which is smaller than a diameter of the friction roll at a portion, which frictionally rubs the surface of the wet paper on the protrusions.

12. A method of manufacturing anti-falsification paper as defined in claim 8, wherein the wet paper is guided by a paper roll (R1) to be brought into intimate contact with the center roll, and a suction nozzle (8), for sucking air, is disposed between the center roll and the paper roll at a position just before the intimate contact of the wet paper with the center roll so as to remove air between the wet paper and the center roll.

13. A method of manufacturing anti-falsification paper as defined in claim 1, wherein a suction hole (7) for sucking the wet paper is disposed on the surface of the center roll between each of the protrusions.

14. A method of manufacturing anti-falsification paper as defined in claim 13, wherein the wet paper is guided by a paper roll (R1) to be brought into intimate contact with the center roll, and a suction nozzle (8), for sucking air, is disposed between the center roll and the paper roll at a position just before the intimate contact of the wet paper with the center roll so as to remove air between the wet paper and the center roll.

15. A method of manufacturing anti-falsification paper as defined in claim 13, wherein the friction roll has a diameter, at a portion other than that which frictionally rubs the surface of the wet paper on the protrusions, which is smaller than a diameter of the friction roll at a portion which frictionally rubs the surface of the wet paper on the protrusions.

16. A method of manufacturing anti-falsification paper as defined in claim 13, wherein a water adding device is used to provide the surface of the wet paper with water when the friction roll frictionally rubs the surface of the wet paper.

17. A method of manufacturing anti-falsification paper as defined in claim 1, wherein the wet paper is guided by a paper roll (R1) to be brought into intimate contact with the center roll, and a suction nozzle (8), for sucking air, is disposed between the center roll and the paper roll at a position just before the intimate contact of the wet paper with the center roll so as to remove air between the wet paper and the center roll.

18. A method of manufacturing anti-falsification paper as defined in claim 17, wherein the friction roll has a diameter, at a portion other than that which frictionally rubs the surface of the wet paper on the protrusions, which is smaller than a diameter of the friction roll at a portion which frictionally rubs the surface of the wet paper on the protrusions.

19. A method of manufacturing anti-falsification paper as defined in claim 17, wherein a water adding device is used to provide the surface of the wet paper with water when the friction roll frictionally rubs the surface of the wet paper.

20. A method of manufacturing anti-falsification paper as defined in claim 1, wherein the friction roll has a diameter, at a portion other than that which frictionally rubs the surface of the wet paper on the protrusions, which is smaller than a diameter of the friction roll at a portion which frictionally rubs the surface of the wet paper on the protrusions.

21. A method of manufacturing anti-falsification paper as defined in claim 20, wherein a water adding device is used to provide the surface of the wet paper with water when the friction roll frictionally rubs the surface of the wet paper.

22. A method of manufacturing anti-falsification paper as defined in claim 1, wherein a water adding device is used to provide the surface of the wet paper with water when the friction roll frictionally rubs the surface of the wet paper.

* * * * *

UNITED STATES PATENT AND TRADEMARK OFFICE

CERTIFICATE OF CORRECTION

PATENT NO. : 6,355,140 B1
DATED : March 12, 2002
INVENTOR(S) : Toru Murakami et al.

It is certified that error appears in the above-identified patent and that said Letters Patent is hereby corrected as shown below:

Title page,
Item [22], should read -- [22] PCT Filed: May 23, 2000 --; and
Item [86], should read -- [86] PCT No.: PCT/JP00/03295 --.

Signed and Sealed this

Third Day of September, 2002

*Attest:*

*Attesting Officer*

JAMES E. ROGAN
*Director of the United States Patent and Trademark Office*